United States Patent [19]

Moog

[11] 4,319,530

[45] Mar. 16, 1982

[54] PALLET HAVING RUNNERS WITH DISPLACEABLE SECTIONS

[75] Inventor: John F. Moog, Creve Coeur, Mo.

[73] Assignee: Innovative Enterprises, Inc., Webster Groves, Mo.

[21] Appl. No.: 126,875

[22] Filed: Mar. 3, 1980

[51] Int. Cl.[3] ..... B65D 19/34

[52] U.S. Cl. ..... 108/51.3; 108/56.1; 206/599

[58] Field of Search ..... 108/51.3, 51.1, 56.1; 206/386, 599, 600

[56] References Cited

U.S. PATENT DOCUMENTS

| | | | |
|---|---|---|---|
| 3,434,434 | 3/1969 | Horton, Jr. | 108/51.3 |
| 3,626,860 | 12/1971 | Blatt | 108/51.3 |
| 3,709,161 | 1/1973 | Kauffman | 108/51.3 X |

FOREIGN PATENT DOCUMENTS

| | | | |
|---|---|---|---|
| 450393 | 8/1948 | Canada | 108/51.3 |

*Primary Examiner*—William E. Lyddane
*Attorney, Agent, or Firm*—Gravely, Lieder & Woodruff

[57] ABSTRACT

A pallet includes a rectangular deck and also runners and pads which are made of a paper honeycomb material and are attached to the underside of the deck to support the deck in an elevated position above a floor, a wood pallet, or some other supporting surface. The runners extend along the sides of the deck for the full length of the deck. The pads, on the other hand, are located between the runners, there being an end pad along each end of the deck and a center pad between the two end pads. Entry slots exist between the pads and runners for the full length of the pallet, and these slots are capable of accommodating the tines of a forklift. Furthermore, the end pads are separated from the center pad by cross channels, which align with sections of the runners that are easily displaced from the remaining portions of the runners under the application of a laterally directed force. The sections that are so displaced are capable of passing through the cross channels, and the voids that are formed will likewise accommodate the tines of a forklift. Thus, the pallet is supplied in the two-way entry configuration for maximum strength, yet is easily converted to the four-way configuration to provide greater versatility. Being formed from paper products, the pallet is inexpensive enough to use on a one-trip basis.

16 Claims, 5 Drawing Figures

A
B
C
T
2
3
4
6
10
12
14
16
18
22
24
26
27
28
29
30
32
4 OR 6

FIG. 2
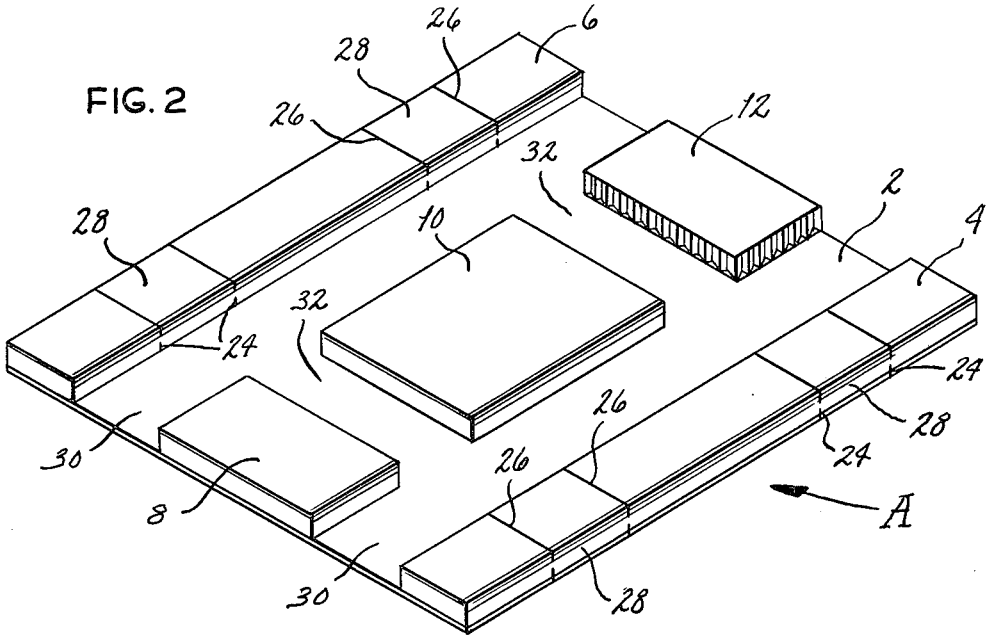
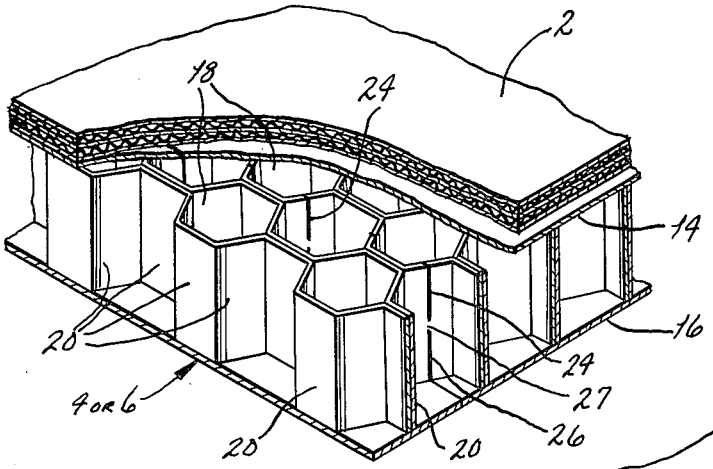
FIG. 4
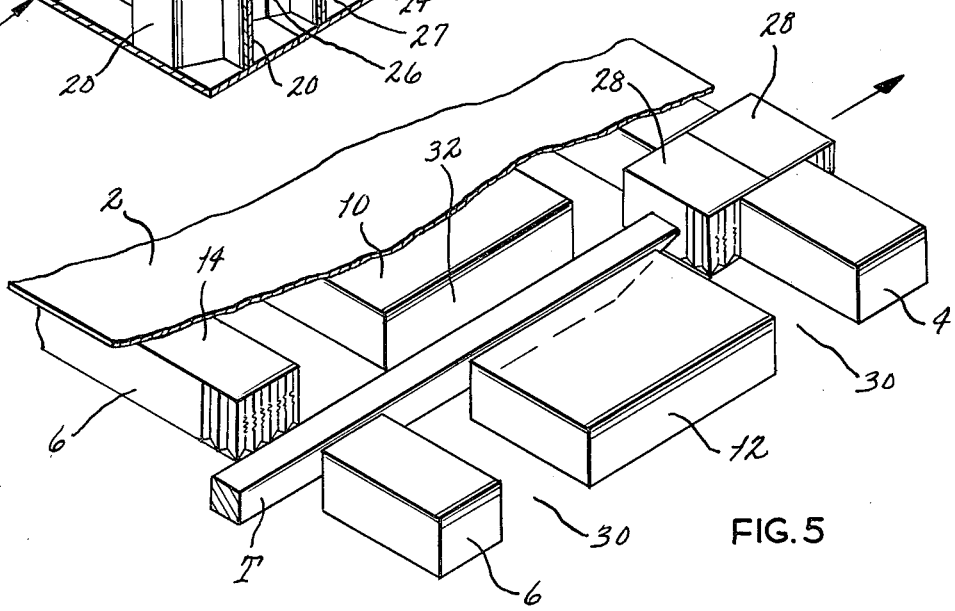
FIG. 5

PALLET HAVING RUNNERS WITH DISPLACEABLE SECTIONS

BACKGROUND OF THE INVENTION

This invention relates in general to load-supporting pallets and, more particularly to a pallet that may be used on a disposable or one-trip basis.

The typical wooden pallet consists of several runners to which boards are nailed to provide a deck on which the load is supported. Of course, the runners elevate the deck and load from the floor or other supporting surface on which the pallet rests so that the tines of a forklift may be inserted beneath the deck. Actually, the spaces between the several runners provide entry slots that receive the tines of the forklift. Since the entry slots open out of only two sides of the pallet, the forklift must approach the pallet from either one of those sides, and hence the pallet is referred to as having two-way entry. Pallets with four-way entry are also available, and in those pallets the runners are merely cut away slightly to provide enough space in them to accommodate the tines of the forklift.

Irrespective of the number of entries, conventional wood pallets are expensive in their own right and further present substantial transportation and control problems. In particular, it is commonplace to ship goods to the purchaser of such goods on pallets, and as a consequence the pallet leaves the possession of the owner. Transportation companies will return the pallets, but the cost is quite high. Furthermore, some pallets are damaged, while others are lost altogether through neglect or pilferage. In some industries the typical wooden pallet is used on an average of no more than twice before it must be replaced. When the large initial expense of the pallet is amortized over only two trips, the pallet expense adds significantly to the cost of the product which is shipped, particularly when the product is relatively inexpensive as holds true with many bagged products. Furthermore, keeping tract of the pallets is an annoying administrative burden.

Aside from the foregoing, a shortage of wood pallets currently exists and it appears that this shortage will continue. This, of course, enhances the incentive to pilfer the pallets or perhaps substitute damaged pallets for return to the original owner. Heretofore attempts have been made to use less expensive materials for pallets, one such material being honeycomb cells made from paper products. While pallets formed from these materials cost considerably less than the typical wood pallets, they have been only suitable for relatively light loads and have not provided the versatility of the conventional wood pallet, particularly as to the number of entries, since providing enough voids in the honeycomb material to accommodate four-way entry has resulted in a significant loss of strength.

SUMMARY OF THE INVENTION

One of the principal objects of the present invention is to provide a load-supporting pallet that is manufactured from inexpensive materials. Another object is to provide a pallet of the type stated that utilizes honeycomb cells for supporting the load in an elevated position. A further object is to provide a pallet of the type stated that may be used on a one-way or one-trip basis, so that it may be disposed of once the goods transported upon it have been removed, or may be reused for multiple trips. An additional object is to provide a pallet of the type stated that is light in weight, yet has relatively high load-supporting capabilities. Still another object is to provide a pallet of the type stated that is supplied and normally used in the two-way entry configuration, wherein it has maximum strength, but is easily converted into the four-way entry configuration which affords greater versatility. Yet another object is to provide a pallet of the type stated that may be used on top of a wood pallet for in-house storage, but will serve as the sole support for goods during transportation of such goods so that the expensive wood pallets may be retained in-house. These and other objects and advantages will become apparent hereinafter.

The present invention is embodied in a pallet having a deck and elevating means attached to the underside of the deck for positioning the deck above a supporting surface. The elevating means includes displaceable sections that are easily dislodged to accommodate the tines of a forklift or similar machine. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur

FIG. 2 is a perspective view of the pallet turned upside down so as to show the pads and runners;

FIG. 4 is a perspective view, partially broken away and in section, of one of the runners, it illustrating the configuration of the honeycomb cells and the location of the slits in them; and FIG. 5 is a partial perspective view showing the plugs of the runners being displaced by the tine of a forklift.

DETAILED DESCRIPTION

Figures 1, 3:
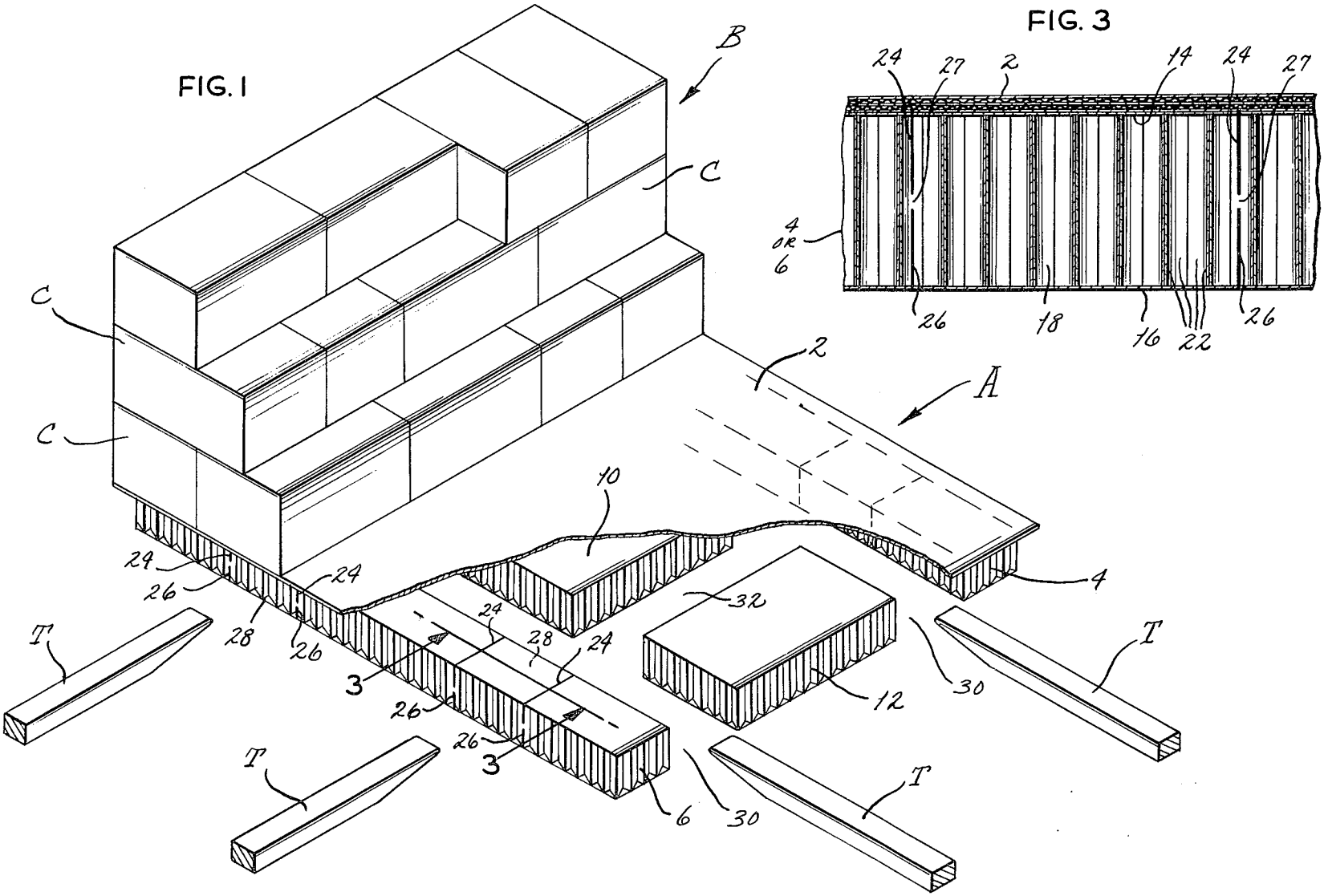
FIG. 1 is a perspective view of a pallet constructed in accordance with and embodying the present invention, the pallet having its deck broken away to show some of the underlying runners and pads.
FIG. 3 is a sectional view of the pallet taken along line 3—3 of FIG. 1 and showing the aligned slits which produce lines of weakness in the runners.

Referring now to the drawings (FIG. 1), A designates a pallet that is used to support a load B which may be a plurality of cartons C arranged such that the load B acts as a unit. This may be achieved by stacking the cartons C in an interlocking arrangement so that the cartons C of any one tier are offset with respect to the cartons C of the underlying tier, insofar as their sides are concerned so as to overlap the cartons C of the underlying tier. Where the loads are arranged in a columnar manner with little or no overlap, the same end may be achieved by confining the load B, such as by bands or with a shrink wrap. The load B, of course, may consist of other types of packaging such as sacks, bags, or for that matter even unpackaged goods. In any event, the pallet A elevates the load B far enough above a floor or other supporting surface to enable the tines T of a forklift or hand truck to pass underneath the load B. The pallet A basically includes (FIGS. 1 and 2) a deck 2, and beneath the deck 2 a pair of runners 4 and 6 that extend along the sides of the deck 2 and supporting pads 8, 10, and 12 that are located between the runners 4 and 6.

The deck 2 provides a flat and continuous upwardly presented surface that typically measures 42×48 inches, although other dimensions are acceptable. The deck 2 need not be rigid, but may be formed from a wide variety of somewhat flexible sheet material such as corrugated paperboard, fiberboard, or thin plywood, to name a few. When corrugated paperboard is employed, it is desirable to have more than one layer of corrugations. Standard corrugated sheet is available having corrugations in multiple layers, or separate corrugated sheets may be joined together. The latter permits cross laminating where the flutes of the different sheets are oriented at right angles.

The runners 4 and 6 are identical and extend along the long side edges of the deck 2, being attached to the downwardly present surface of the deck 2. Each runner 4 and 6 is formed from honeycomb material, and that material essentially comprises spaced apart facer sheets 14 and 16 (FIG. 4) with honeycomb cells 18 interposed between the sheets such that the longitudinal axes of the cells 18 are perpendicular to the sheets 14 and 16. Both the facer sheets 14 and 16 and the cells 18 are formed from kraft paper. As to the cells 18, they are created by rows 20 of paper, with each row 20 being as wide as the spacing between the sheets 14 and 16 and in a sense further being corrugated. However, the corrugations are formed by distinct bends in the paper, with the included angle at each bend being 120°. The folds in effect divide each row 20 into cell walls 22, and as to each pair of adjacent rows every fourth wall abuts a corresponding wall 22 of the adjacent row 20. The net effect is to provide a series of hexagonal cells 18. The abutting walls of adjacent rows 20 are joined firmly together by a suitable glue, and the rows 20 comprising the cells 18 are further joined by glue along their end edges to the upper and lower facer sheets 14 and 16. Honeycomb material of the type described is commercially available in large slabs of varying thickness, with ¾ inch to 4 inches thickness being best suited for the runners 4 and 6. These slabs are easily slit with slowly rotating blades to provide the runners 4 and 6 which may be 6 inches wide and should extent substantially the full length of the deck 2.

Each runner 4 and 5 has a series of slits 24 (FIGS. 1–4) that extend completely across its upper facer sheets 14 and another series of slits 26 that extend completely across its lower facer sheet 16. Moreover, each slit 24 in the upper sheet 14 aligns with a slit 26 in the bottom sheet 16, so that the slits 24 and 26 are arranged in pairs along the runners, with the slits 24 and 26 of each pair lying in the same vertical plane, that is, in a plane that is perpendicular to the deck 2. Not only do the slits 24 and 26 extend completely through their respective sheets 14 and 16, but they also extend into the walls 22 of the honeycomb cells 18 that are located along them (FIGS. 3 and 4). However, the penetration into the walls 22 is not so great as to join the slits 24 and 26. On the contrary, the inner margins for the slits 24 and 26 of each pair are separated about 1/16 to 5/16 inches and preferably from ⅛ to 3/16 inches (FIGS. 3 and 4), and these areas constitute short connecting segments 27. In other words, along the slits 24 and 26 the cell walls 22 have short connecting segments 27 of at least 1/16 to 5/16 inches which keep the cell walls 22 intact, even though the cell walls 22 are considerably higher. The aligned slits 24 and 26 create regions or, more accurately, planes of weakness through the runners 4 and 6, with the weakness being in the lateral direction, but not the vertical direction so as not to impair the compressive strength of the runners 4 and 6. Moreover, the slits 24 and 26 are arranged along each runner 4 or 6 so as to delineate sections or plugs 28 that are slightly wider than the tines T of a conventional forklift and are positioned to align with those tines. Actually, the plugs 28 should be about 1 to 2 inches wider than the tines T of the forklift, so that when the tines T are aligned with the plugs 28, a clearance of ½ to 1 inch will exist to the sides of the tines T.

Each runner 4 and 6 is attached to the deck 2 with its upper facer sheet 14 adhered to the lower surface of the deck 2 by means of a suitable glue, but the glue does not exist along the plugs 28, so that the plugs 28 remain detached from the deck 2. As a consequence, a laterally directed force applied to a plug 28 will cause the honeycomb cells 18 to tear along the slits 24 and 26, or more accurately at the connecting segments 27, and this in turn enables the plug 28 to be dislodged from the remainder of the runner 4 or 6 with relatively little effort. In effect, the plugs 28 constitute displaceable portions or sections of the runners 4 and 6.

The two endmost supporting pads 8 and 12 are rectangular and lie along the ends or short sides of the deck 2 (FIG. 2). They are formed from the same honeycomb material as the runners 4 and 6. While one side of each pad 8 and 12 lies along the short side of the deck 2, the other or parallel side, which is set inwardly, aligns with the outermost pairs of slits 24 and 26 in the runners 4 and 6. The end pads 8 and 12 are further centered midway between the long sides of the deck 2 with their ends being spaced from the runners 4 and 6 so as to form entry channels or slots 30 that are wide enough to accommodate the tines T of a forklift. Of course, the spacing between the two entry slots 30 is such that they will align with the tines T. Actually, the slots 30, like the plugs 28, should be 1 to 2 inches wider than the tines T of the forklift so that when the tines T are aligned with the slots 30, a clearance of ½ to 1 inch will exist along the sides of the tines T. The end pads 8 and 12 are attached to the downwardly presented face of the deck 2 by a suitable glue which is applied to the upper facer sheets 14 of the two pads 8 and 12.

The center supporting pad 10 is likewise formed from the same honeycomb material and it has its sides aligned with the corresponding ends of the end pads 8 and 12 so that the entry slots 30 continue along the pad 10 without any variation in width. Moreover, the ends of the pad 10 align with the innermost pairs of slits 24 and 26 in the runners 4 and 6 so as to form cross channels 32 that align with the plugs 28 and are of the same or slightly greater width. The center pad 10 is secured to the deck 2 by means of glue between the upper facer sheet 14 on the pad 10 and the lower surface of the deck 2.

With the plugs 28 in place within their respective runners 4 and 6, the runners 4 and 6 together with the pads 8, 10, and 12 should underlie between 45% and 65% of the total surface area of the deck 2, and preferably should underlie at least 50% of that surface area. This is considerably greater than honeycomb pallets of present construction, for these pallets attempt to duplicate the runners of wood pallets with honeycomb material and rely on the rigidity of the deck to carry the load in the large voids where no honeycomb material exists. Since the runners 4 and 6 and the pads 8, 10, and 12 of the pallet A underlie a substantial portion of the deck 2, the rigidity or lack of it in the deck 2 is not a critical factor, and indeed the deck 2 may be formed from somewhat flexible materials such as corrugated paperboard.

OPERATION

In use, the pallet A is normally set upon a more rigid wood pallet with the deck 2 of the pallet A presented upwardly (FIG. 1). As a consequence, the lower facer sheets 16 of the runners 4 and 6 and the supporting pads 8, 10 and 12 contact the deck of the wood pallet. Thereupon, the cartons C are stacked upon the deck 2 of the pallet A, preferably in a manner that in effect unitizes the load B that is so formed. In this regard, the cartons C, at least in the lowermost tier, should have their smallest horizontal dimension greater than the width of the plugs 28, the slots 30, or cross channels 32, whichever is greatest, and should further be placed so as to span the plugs 28, slots 20, and channels 32, if at all possible. The same applies to other types of loads such as bags. Another pallet A may be placed upon the top of the load B and loaded in a similar manner.

In the alternative the pallet A may be placed directly upon a floor and loaded. However, the use of a wood pallet beneath the lowermost pallet A is preferred since it reduces the risk of damaging the lowermost pallet A during initial in house handling.

The fully loaded pallet A supports the cartons C at a sufficient height above the underlying supporting surface, irrespective of what it may be, to enable the tines T of a forklift or handtruck to pass under the deck 2 of the pallet A and lift the pallet A upwardly. To this end, the deck 2 is supported along its longer sides by the runners 4 and 6, and this support is continuous, that is, each long side of the deck 2 is supported along substantially its entire length. At its shorter sides, that is at its ends, the deck 2 is supported by the end pads 8 and 12, while in its center it is supported by the center pad 10. The only unsupported regions exist over the entry slots 30 and over the channels 32, but by reason of the unitized nature of the load B, the load B to a large measure bridges these voids, and is taken entirely by the runners 4 and 6 and the pads 8, 10 and 12.

To move the pallet A and its load B, the tines T of a forklift are aligned with the entry slots 30 at either end of the pallet A and then advanced into those slots 30 for the full length of the pallet A. Care should be exercised so as not to contact the runners 4 and 6 or the pads 8, 10 and 12, since any damage to the walls 22 of the honeycomb cells 18 will reduce their ability to support the load B. In any event, once the tines T are fully inserted, they are elevated, and this of course carries the pallet A upwardly so that it can be moved to another location or placed on a transportation vehicle.

Normally several pallets A and their respective loads B are stored in a stack with the lowermost pallet A resting upon a wood pallet. When a palletized load B is to be shipped, it is moved on its pallet A to a transportation vehicle. This is easily achieved merely be inserting the tines of a forklift into the entry slots 30 of the pallet A and lifting the pallet A and its load upwardly. Only the pallet A and its load B are placed on the transportation vehicle, but unlike warehouses, these vehicles do not permit high stacking of the palletized loads B. Consequently, the pallets A are usually under less compressive stress in a transportation vehicle. The expensive wood pallet on the other hand, remains at the place of original storage so that it never leaves the possession of its owner.

In some instances, the pallets A are arranged such that the entry slots 30 along the short sides are less accessible than the plugs 28 along the runners 4 or 6, as might well be the case when unloading the transportation vehicle. In that instance, the tines T of the forklift or handtruck are aligned with the plugs 28 in the runner 4 or 6 that is exposed. Thereupon the tines T are advanced into the plugs 32. The force exerted on the plugs 28 causes them to tear along the short connecting segments 27 between pairs of aligned slits 24 and 26, and as a consequence, the plugs 28 are dislodged and advanced through the cross channels 32 under the force exerted by the tines T of the forklift (FIG. 5). The dislodged plugs 28 thereupon bear against the plugs 28 in the other runner 4 or 6 and exert a laterally directed force upon those plugs 28. Again, the force has sufficient magnitude to tear the cell walls 22 at the connecting segments 27 and dislodge the plugs 28 in the other runner 4 or 6. The tines T are advanced far enough to bring both of the dislodged plugs 28 completely beyond the opposite long side of the deck. Thereupon, the tines T are elevated to lift the pallet A and its load B upwardly so that the two can be moved.

The presence of the plugs 28 in the runners 4 and 6 enables the pallet A to, in most instances, support loads that cannot be accommodated by honeycomb pallets having a four-way entry capability. Yet the pallet A has four-way entry capability. In most situations, the four-way entry capabilities are utilized only when the pallet A and its load are to be removed from a transportation vehicle and placed at some location where the load is to be removed from the pallet A. In those instances, it makes little difference if the strength lost by the removal of the plugs 28 weakens the pallet A to the extent that the runners 4 and 6 and pads 8, 10, and 12 collapse.

Moreover, the cost of the pallet A is so little that it may be disposed of after the load B is removed from it. In other words, the cost of handling and returning the pallet A would probably exceed its value, so it is more economical for the user to merely discard the pallet A once its purpose has been served. On the other hand, the pallet A, if it is not damaged, may be used over and over again. Also, the pallet A weighs about one-tenth as much as a conventional wood pallet, so it, in-and-of itself, is quite easily handled.

As a modification, the pads 8, 10, and 12 may be united into a single center runner having displaceable plugs in the regions of the cross channels 32. These plugs would likewise be bounded by slits 24 and 26 arranged in aligned pairs. Similarly, the end pads 8 and 12 may be extended all the way to the runners 4 and 6 and provided with slits in the regions of the inner edges of the slots 30 along the center pad 10, thus creating more displaceable plugs along the short sides of the pallet A. Furthermore, in lieu of two slits 24 separated by a connecting segment 27 to create a region of weakness, a single slit may be extended through the lower facer sheet 16 and overlying cell walls 22 to the upper facer sheet 14, or at least in close proximity to it, in which case the upper facer sheet 14 would hold the plugs 28 in place and constitute the region of weakness. The reverse may also be employed, in which the lower facer sheet 16 would form the region of weakness.

This invention is intended to cover all changes and modifications of the example of the invention herein chosen for purposes of the disclosure which do not constitute departures from the spirit and scope of the invention.

What is claimed:

1. A pallet comprising: a deck having an upwardly presented surface on which a load may be supported and a downwardly presented surface; runners attached to the deck at its downwardly presented surface near the sides of the deck and extending along the deck generally parallel to each other for supporting the deck in an elevated position above a supporting surface, each runner being formed from paper arranged in a honeycomb configuration so as to include a multiplicity of parallel honeycomb cells, the axes of which are generally perpendicular to the deck, each runner being substantially continuous along its side of the deck and having a pair of sections that are connected to the remainder of the runner at regions of weakness but are otherwise detached from the deck so that a laterally directed force applied to any section will cause it to separate from the remainder of the runner and create a void in the runner, the sections of each runner being spaced apart sufficiently to accommodate the tines of a forklift or handtruck, corresponding sections in the two runners being aligned with each other; and a pair of end pads and a center pad attached to the deck at its downwardly presented surface between the two runners such that the end pads are located along the ends of the deck and the center pad is between the two end pads generally beneath the center of the deck, the runners and the pads being spaced apart to provide entry slots which open out of the ends of the pallet, with the slots being wide enough and spaced apart sufficiently to accommodate the tines of a forklift or handtruck, the pads being further positioned such that cross channels exist between the end pads and the center pad, with the cross channels being aligned with and wide enough to accommodate the displaceable sections of the runners, each pad being formed from paper arranged in a honeycomb configuration so as to include a multiplicity of parallel honeycomb cells with the axes of the cells being perpendicular to the deck.

2. A pallet according to claim 1 wherein the runners are secured to the downwardly presented surface of the deck, except at the displaceable sections.

3. A pallet according to claim 2 wherein the displaceable sections are separated from the remainder of the runners by slits that extend completely across the elevating means generally perpendicular to the deck and at least partially penetrate the honeycomb cells, thereby creating the regions of weakness in the elevating means.

4. A pallet according to claim 3 wherein the runners and pads, in addition to the honeycomb cells, include facer sheets that extend over and are attached to the paper of the honeycomb cells at the ends of the honeycomb cells, and wherein the upper of the facer sheets is attached to the downwardly presented surface of the deck.

5. A pallet according to claim 4 wherein the slits are arranged in pairs with one slit of each pair severing the upper facer sheet and extending into the honeycomb cells and the other slit of the pair severing the lower facer sheet and also extending into the honeycomb cells, the two slits of each pair lying in the same vertical plane, but having their inner margins spaced apart so that short connecting segments remain in between the slits.

6. A pallet according to claim 5 wherein the spacing between the inner margins for the slits of each pair ranges between about 1/16 inch and about 5/16 inch.

7. A pallet according to claim 1 wherein the deck is formed from a lightweight material that is somewhat flexible.

8. A pallet according to claim 7 wherein the deck is formed from corrugated paperboard.

9. A pallet according to claim 1 wherein the pads together with the runners underlie at least 45% of the deck.

10. A pallet comprising: a deck having an upwardly presented surface on which a load is to be positioned and a downwardly presented surface, the deck being generally rectangular in configuration and having generally parallel first sides and generally parallel second sides with the second sides being generally perpendicular to the first sides, elongated runners attached to the deck at its downwardly presented surface and extending substantially the full length of the deck along its first sides for supporting the deck in an elevated position above a supporting surface, there being a separate runner along each first side, each runner having a pair of sections that are displaceable from the remainder of the runner upon the application of a laterally directed force, with the sections being spaced apart sufficiently to accommodate the tines of a forklift or handtruck, and intermediate supporting means also attached to the deck at its downwardly presented surface and located between the two runners for aiding the runners in supporting the deck in the elevated position, the intermediate supporting means being substantially the same height as the runners and further being spaced from the runners so as to provide a pair of entry slots which are large enough and are positioned such as to accommodate the tines of a forklift or handtruck, the intermediate supporting means including a plurality of sections which are spaced apart to provide cross channels which align with and are wide enough to accommodate the displaceable sections of the runners, whereby the tines of a forklift or handtruck may enter the pallet from either the first or the second sides of the deck, the runners and intermediate supporting means together underlying at least 45% of the deck and being formed from honeycomb material having paper configured to form honeycomb cells, the axes of which are perpendicular to the deck, and facer sheets attached to the paper of the cells at the upper ends of the cells, the facer sheets being attached to the downwardly presented surface of the deck except at the displaceable sections of the runners.

11. A pallet according to claim 10 wherein the intermediate supporting means includes an end pad along each of the second sides and a center pad between the two end pads, the center pad being separated from the two end pads by the cross channels.

12. A pallet according to claim 10 wherein the displaceable sections are joined to the remaining portions of the runners along regions of lateral weakness.

13. A pallet according to claim 10 wherein the displaceable sections are bounded by slits which extend into the honeycomb material and provide regions of lateral weakness in the material.

14. A pallet according to claim 10 wherein the deck is formed from corrugated paperboard.

15. A pallet according to claim 10 wherein the runners and intermediate supporting means further have other facer sheets attached to the paper of the cells at the lower ends of the cells.

16. A pallet according to claim 15 wherein the other facer sheets of runners and intermediate supporting means form the lowest surface of the pallet and contact an underlying supporting surface on which the pallet rests.

* * * * *